US009694491B1

(12) United States Patent
Kao

(10) Patent No.: US 9,694,491 B1
(45) Date of Patent: Jul. 4, 2017

(54) HAND TOOL FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/067,740

(22) Filed: Mar. 11, 2016

(51) Int. Cl.
*B25H 3/04* (2006.01)
*B25H 3/00* (2006.01)

(52) U.S. Cl.
CPC ..... *B25H 3/04* (2013.01); *B25H 3/003* (2013.01)

(58) Field of Classification Search
CPC . B25H 5/00; B25H 3/00; B25H 3/003; B25H 3/006; B25H 3/04
USPC ..... 211/70.6
See application file for complete search history.

(56) References Cited

U.S. PATENT DOCUMENTS 5,645,177 A * 7/1997 Lin ..... B25H 3/04 206/378
6,431,373 B1 * 8/2002 Blick ..... B25H 3/003 206/378
6,637,605 B2 * 10/2003 Ernst ..... B25H 3/003 206/378
7,152,747 B2 * 12/2006 Wang ..... A47F 7/024 211/70.6
8,302,786 B2 * 11/2012 Kao ..... A47F 5/0846 211/70.6
8,403,155 B1 * 3/2013 Kao ..... B25H 3/04 206/376
8,479,929 B1 * 7/2013 Kao ..... B25H 3/04 211/69
9,205,553 B2 * 12/2015 Ou ..... B25H 3/04
2002/0121491 A1 * 9/2002 Ernst ..... A47F 7/0035 211/70.6
2006/0118499 A1 * 6/2006 Kao ..... A47F 5/083 211/70.6
2009/0090644 A1 * 4/2009 Kao ..... B25H 3/04 206/373
2009/0194494 A1 * 8/2009 Kao ..... A47F 5/0838 211/70.6
2010/0001159 A1 * 1/2010 Kao ..... B25H 3/04 248/316.4

* cited by examiner

*Primary Examiner* — Korie H Chan
(74) *Attorney, Agent, or Firm* — patenttm.us

(57) ABSTRACT

A hand tool frame has a track base, a positioning board, at least one positioning mount, and an engaging structure. The track base has a bottom panel, a slide rail, and a connecting track. The positioning board is mounted in the connecting track. The at least one positioning mount is slidably mounted on the track base, and each has a sliding seat and an extending element. The sliding seat is slidably mounted in the slide rail and abuts the positioning board. The extending element is formed on the sliding seat and extends out of the slide rail. The engaging structure is formed between the positioning board and the at least one positioning mount to enable the at least one positioning mount to position securely on the positioning board without sliding relative to the track base, and has at least one first engaging segment and a second engaging segment.

15 Claims, 17 Drawing Sheets

HAND TOOL FRAME

BACKGROUND OF THE INVENTION

1. Field of the Invention

The present invention relates to a hand tool frame, and more particularly to a hand tool frame that may provide a positioning effect to hand tools that are mounted on the hand tool frame and may improve the practicality of the hand tool frame.

2. Description of Related Art

With reference to FIG. 17, a conventional hand tool frame 80 has a track base 81 and multiple positioning mounts 82. The track base 81 is an elongated seat and has a front side and a slide rail 811. The slide rail 811 is formed in the front side of the track base 81. The positioning mounts 82 are slidably mounted in the slide rail 811 of the track base 81. Then, hand tools such as sleeves, wrenches or screwdrivers may be securely mounted on the positioning mounts 82 to store the hand tools on the track base 81 of the conventional hand tool frame 80.

Furthermore, when the conventional hand tool frame 80 is used to store sleeves, each one of the positioning mounts 82 has a sliding seat 821 and an inserting button 822. The sliding seat 821 is round and is slidably mounted in the slide rail 811 of the track base 81 and has a front surface. The inserting button 822 is rectangular, is formed on and protrudes from the front surface of the sliding seat 821 and extends out of the slide rail 811. In use, a sleeve 90 is mounted around the inserting button 822 of one of the positioning mounts 82 without rotating relative to inserting button 822 of the positioning mount 82 since the inserting button 822 is rectangular. The user needs to rotate the round sliding seat 821 of the positioning mount 82 relative to the slide rail 811 to allow the sleeve 90 to rotate to enable a number or sign on the sleeve 90 to face the user. After rotating the sliding seats 821 of the positioning mounts 82 relative to the track base 81, the sleeves 90 that are mounted around the inserting buttons 822 of the positioning mounts 82 may be adjusted to enable numbers or signs on the sleeves 90 to face a same direction for the user.

Though the conventional hand tool frame 80 may provide a rotation adjustment effect to the sleeves, the sliding seats 821 of the positioning mounts 82 lack engaging structures relative to the slide rail 811 of the track base 81 to hold the sleeves 90 securely on the track base 81 at specific positions. When a sleeve 90 of a large size is mounted around an upper positioning mount 82, the upper positioning mount 82 may slide downwardly along the slide rail 811 due to the weight of the sleeve 90 of a large size and also because the track base 81 is disposed longitudinally. Then, the sleeve 90 of a large size and the upper positioning mount 82 may knock against a lower positioning mount 82, and the positioning mounts 82 may gather at a bottom of the track base 81, and this may hinder the user from clearly observing and distinguishing the sizes of the sleeves by the numbers or signs.

Furthermore, when the user wants to take a sleeve 90 of a small size that is mounted on a lower positioning mount 82, the upper positioning mount 82 may slide downwardly with the large size sleeve 90 to shorten a distance between the two adjacent positioning mounts 82 and knock against the lower positioning mount 82. After using the small size sleeve 90, the user needs to move the upper positioning mount 82 and the large size sleeve 90 upwardly to recover the distance between the two adjacent positioning mounts 82 to re-mount the small size sleeve 90 on the lower positioning mount 82, and this is inconvenient in use and storage.

In addition, when the conventional hand tool frame is used to store wrenches or screwdrivers, since the round sliding seats 821 of the positioning mounts 82 may rotate and slide relative to the slide rail 811 of the track base 81, and the two adjacent positioning mounts cannot hold one of the wrenches or screwdrivers securely on the track base 81, and this may limit the practicality of the conventional hand tool frame.

To overcome the shortcomings, the present invention tends to provide a hand tool frame to mitigate the aforementioned problems.

SUMMARY OF THE INVENTION

The main objective of the invention is to provide a hand tool frame that may provide a positioning effect to hand tools that are mounted on the hand tool frame and may improve the practicality of the hand tool frame.

A hand tool frame in accordance with the present invention has a track base, a positioning board, at least one positioning mount, and an engaging structure. The track base has a bottom panel, a slide rail, and a connecting track. The positioning board is mounted in the connecting track. The at least one positioning mount is slidably mounted on the track base, and each has a sliding seat and an extending element. The sliding seat is slidably mounted in the slide rail and abuts the positioning board. The extending element is formed on the sliding seat and extends out of the slide rail. The engaging structure is formed between the positioning board and the at least one positioning mount to enable the at least one positioning mount to position securely on the positioning board without sliding relative to the track base, and has at least one first engaging segment and a second engaging segment.

Other objects, advantages and novel features of the invention will become more apparent from the following detailed description when taken in conjunction with the accompanying drawings.

DETAILED DESCRIPTION OF PREFERRED EMBODIMENT

Figure 1:
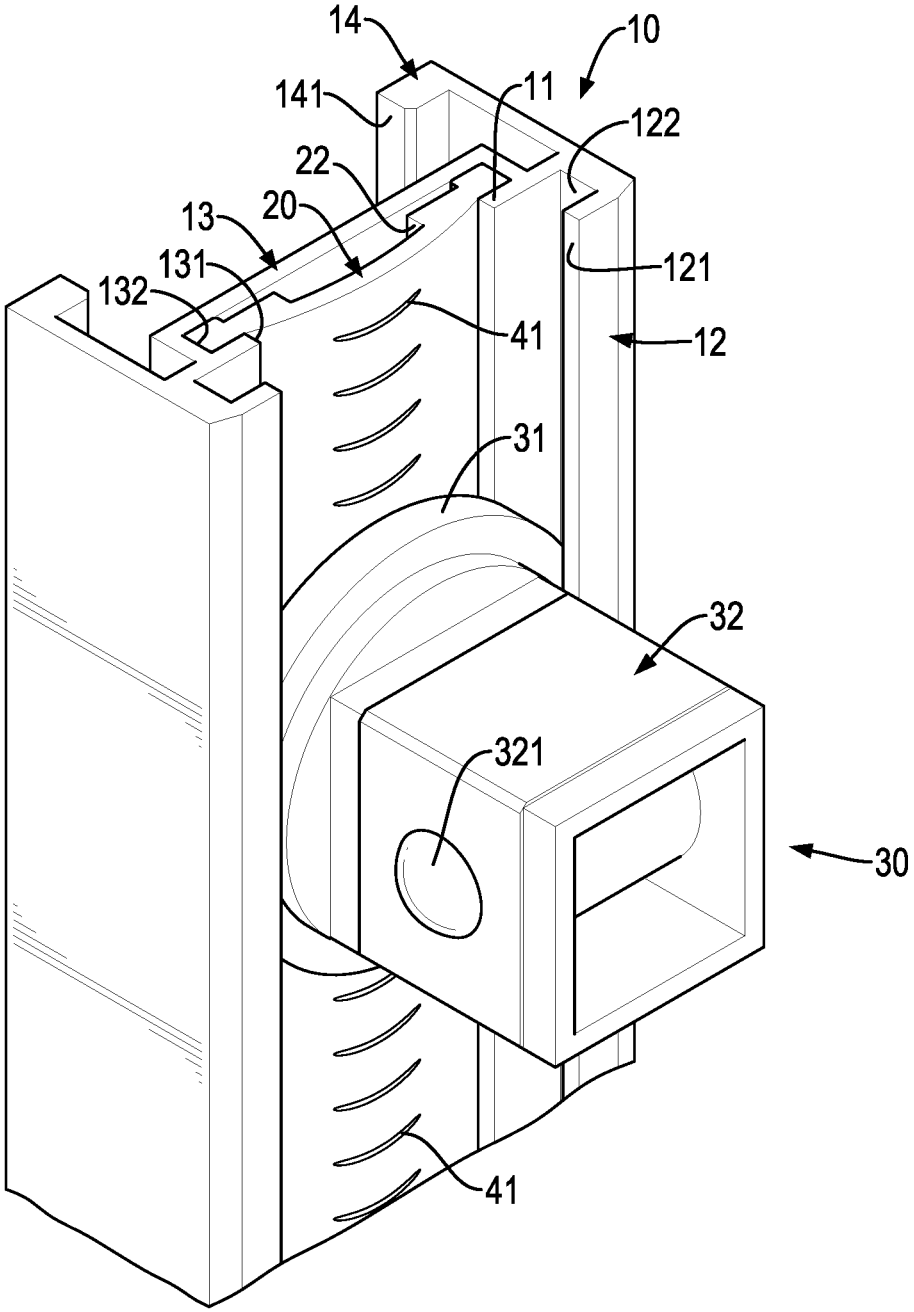
FIG. 1 is an enlarged perspective view of a first embodiment of a hand tool frame in accordance with the present invention.
Figure 2:
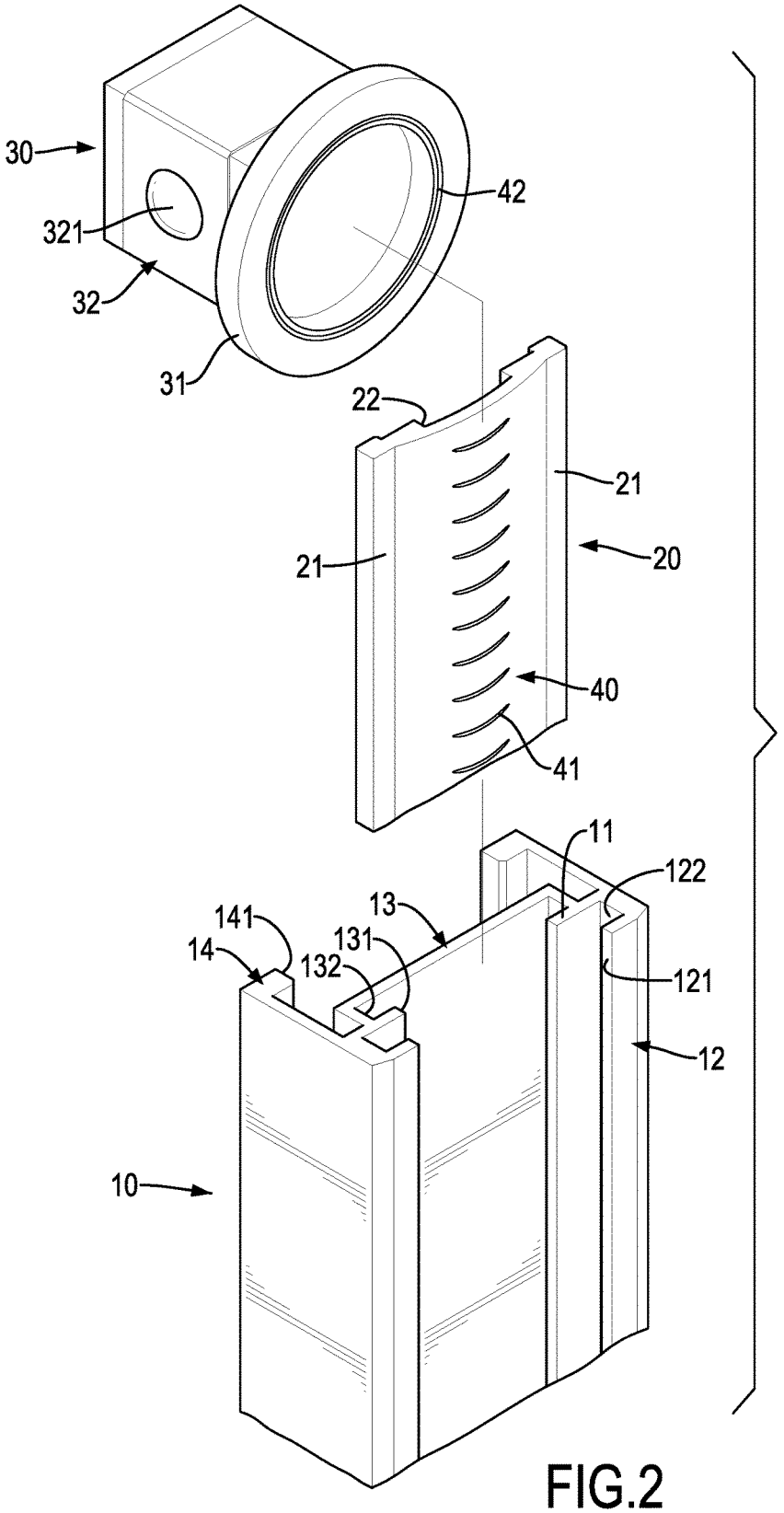
FIG. 2 is an enlarged and exploded perspective view of the hand tool frame in FIG. 1.
Figure 3:
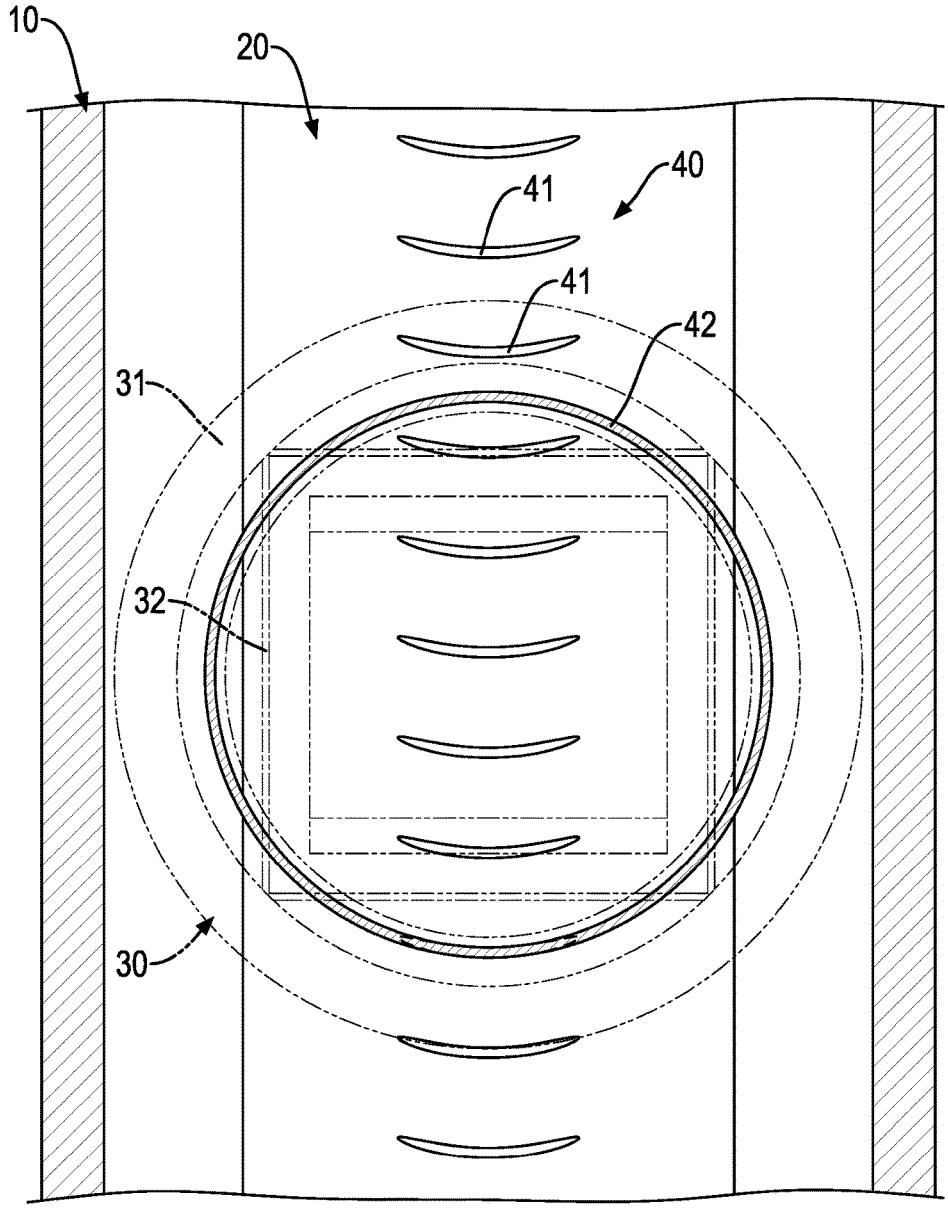
FIG. 3 is an enlarged cross sectional front side view of the hand tool frame in FIG. 1.

With reference to FIGS. 1 to 4, a first embodiment of a hand tool frame in accordance with the present invention comprises a track base 10, a positioning board 20, at least one positioning mount 30, and an engaging structure 40.

The track base 10 is made of aluminum, is an elongated seat and has a bottom panel 11, a slide rail 12, a connecting track 13, and a closed track 14. The bottom panel 11 is elongated and has a front surface, a rear surface, a top end, and a bottom end. The slide rail 12 is formed on and protrudes from the front surface of the bottom panel 11 between the top end and the bottom end of the bottom panel 11 and has a front side, a front opening 121, and a sliding recess 122. The front opening 121 is formed through the front side of the slide rail 12. The sliding recess 122 is formed in the slide rail 12 between the front side of the slide rail 12 and the front surface of the bottom panel 11 and communicates with the front opening 121.

The connecting track 13 is formed on and protrudes from the rear surface of the bottom panel 11, and has a front side, a communicating opening 131, and a connecting recess 132. The front side of the connecting track 13 is formed on and protrudes from the rear surface of the bottom panel 11. The communicating opening 131 is formed through the front side of the connecting track 13 and the rear surface of the bottom panel 11, and communicates with the sliding recess 122 of the slide rail 12. The connecting recess 132 is formed between the bottom panel 11 and the connecting track 13 and communicates with the communicating opening 131. Additionally, a width of the communicating opening 131 of the connecting track 13 is narrower than a width of the front opening 121 of the slide rail 12.

The closed track 14 is formed on and protrudes from the rear surface of the bottom panel 11 around the connecting track 13 and has a rear side and a rear opening 141 formed through the rear side of the closed track 14. In addition, the closed track 14 and the slide rail 12 are formed on the bottom panel 11 as a single piece.

The positioning board 20 is elastic, is mounted in the connecting track 13 of the track base 10 and has two long opposite sides, two free ends, a middle, a front surface, a rear surface, two rail bars 21, and a through recess 22. The positioning board 20 is bent forwardly from the long opposite sides of the positioning board 20 to the middle of the positioning board 20. Then, the front surface of the positioning board 20 at the middle of the positioning board 20 extends at the communicating opening 131 of the connecting track 13.

The two rail bars 21 are formed on and protrude outwardly from the rear surface of the positioning board 20 respectively at the two long opposite sides of the positioning board 20 and are mounted in the connecting recess 132 of the connecting track 13. The through recess 22 is formed in the rear surface of the positioning board 20 at the middle of the positioning board 20 between the free ends of the positioning board 20, is parallel with the long opposite sides of the positioning board 20 and communicates with the connecting recess 132 of the connecting track 13. Then, a space is formed between the connecting track 13 and the middle of the positioning board 20, and the space may allow the middle of the positioning board 20 to deform relative to the track base 10.

The at least one positioning mount 30 is slidably and rotatably mounted on the track base 10, and each one of the at least one positioning mount 30 has a sliding seat 31 and an extending element 32. The sliding seat 31 is round, is slidably mounted in the sliding recess 122 of the slide rail 12 and abuts the front surface of the positioning board 20. The sliding seat 31 has a rear side and a front side. The rear side of the sliding seat 31 faces the communicating opening 131 of the connecting track 13 and abuts the front surface of the positioning board 20. The front side of the sliding seat 31 faces the front opening 121 of the slide rail 12.

The extending element 32 is formed on and protrudes forwardly from the front side of the sliding seat 31 and extends out of the slide rail 12 via the front opening 121. The extending element 32 is used to hold a hand tool. Furthermore, in the first embodiment of the hand tool frame, the extending element 32 of each one of the at least one positioning mount 30 is an inserting button. The inserting button is hollow, is rectangular and has a side surface and a protruding ball 321. The protruding ball 321 is mounted in and extends outwardly from the side surface of the inserting button. Additionally, in the first embodiment, the hand tool frame has multiple positioning mounts 30 slidably and rotatably mounted on the track base 10 and abutting the positioning board 20.

The engaging structure 40 is formed between the positioning board 20 and the at least one positioning mount 30 to enable the at least one positioning mount 30 to position securely on the positioning board 20 without sliding relative to the track base 10. The engaging structure 40 has at least one first engaging segment 41 and a second engaging segment 42.

The at least one first engaging segment 41 is deposited on the front surface of the positioning board 20 at the middle of the positioning board 20. Furthermore, each one of the at least one first engaging segment 41 is a curved engaging slot and is formed in the front surface of the positioning board 20 at the middle of the positioning board 20. In addition, the hand tool frame has multiple first engaging segments 41 deposited on the front surface of the positioning board 20 at spaced intervals to form multiple engaging slots on the positioning board 20.

The second engaging segment 42 is deposited on the rear side of the sliding seat 31 of the at least one positioning mount 30, and selectively engages with the at least one first engaging segment 41 to hold the at least one positioning mount 30 securely on the positioning board 20 without sliding relative to the track base 10. In addition, the second engaging segment 42 is an engaging ring, is formed on and protrudes from the rear side of the sliding seat 31 of the at least one positioning mount 30, and selectively engages one of the engaging slots on the positioning board 20. Then, the at least one positioning mount 30 may be securely held on the positioning board 20 without sliding relative to the track base 10.

Figures 4, 4A, 4B:
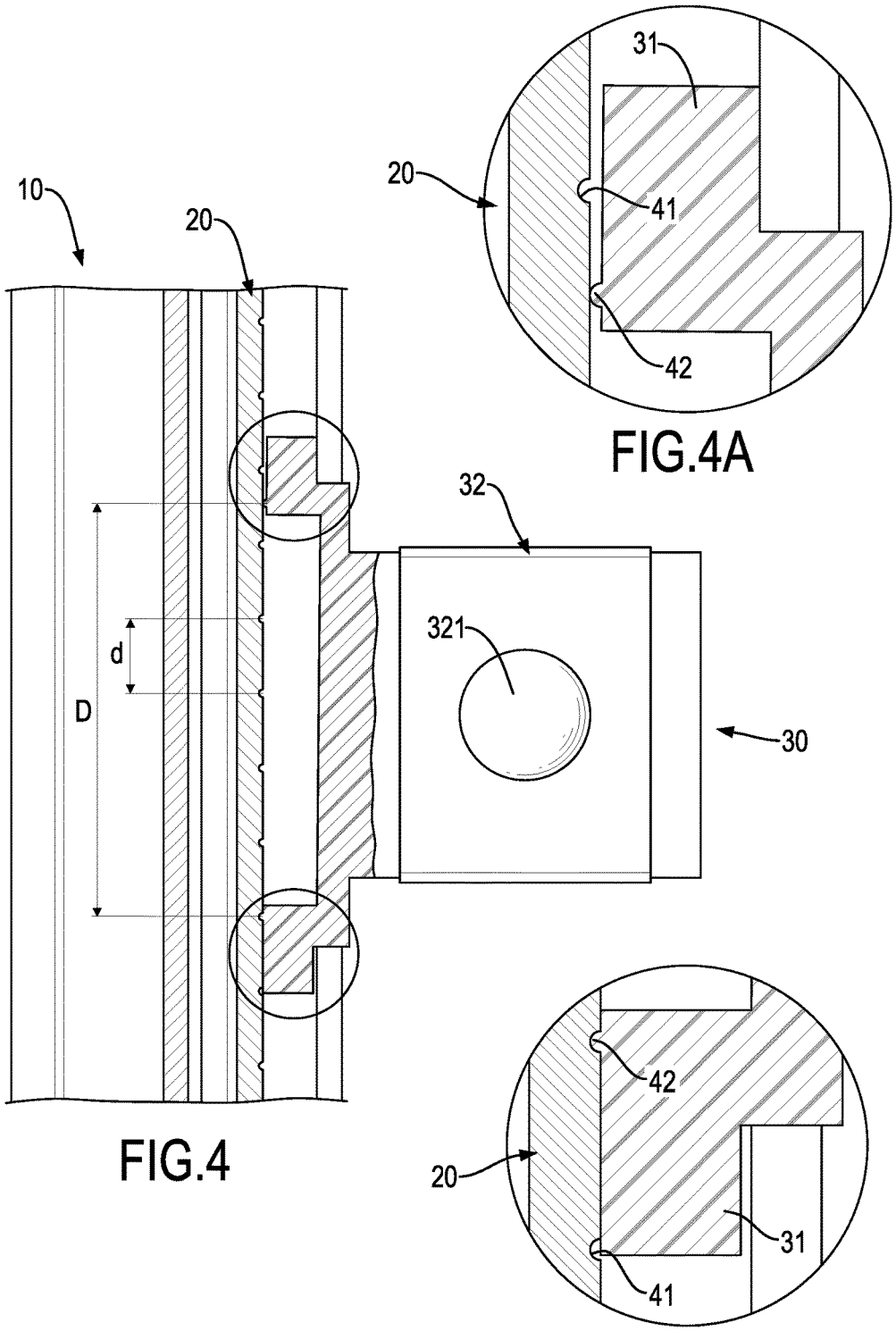
FIG. 4 is an enlarged side view in partial section of the hand tool frame in FIG. 1.
FIGS. 4A and 4B are enlarged side views of the hand tool frame in FIG. 4.

With further reference to FIGS. 4, 4A, and 4B, an interval d is between two adjacent engaging slots of the engaging structure 40, and the engaging ring has an inner diameter D, and a mathematical relationship between the interval d and the inner diameter D is $5d<D<6d$, and this enables a part of the engaging ring to engage in one of the engaging slots and the remaining part of the engaging ring presses against the front surface of the positioning board 20 at the middle of the positioning board 20. Then, the abutment relationship between the engaging ring and the positioning board 20 may allow the part of the engaging ring to engage more securely in the corresponding engaging slot, and the at least one positioning mount 30 may be securely positioned on the positioning board 20.

Figure 5:
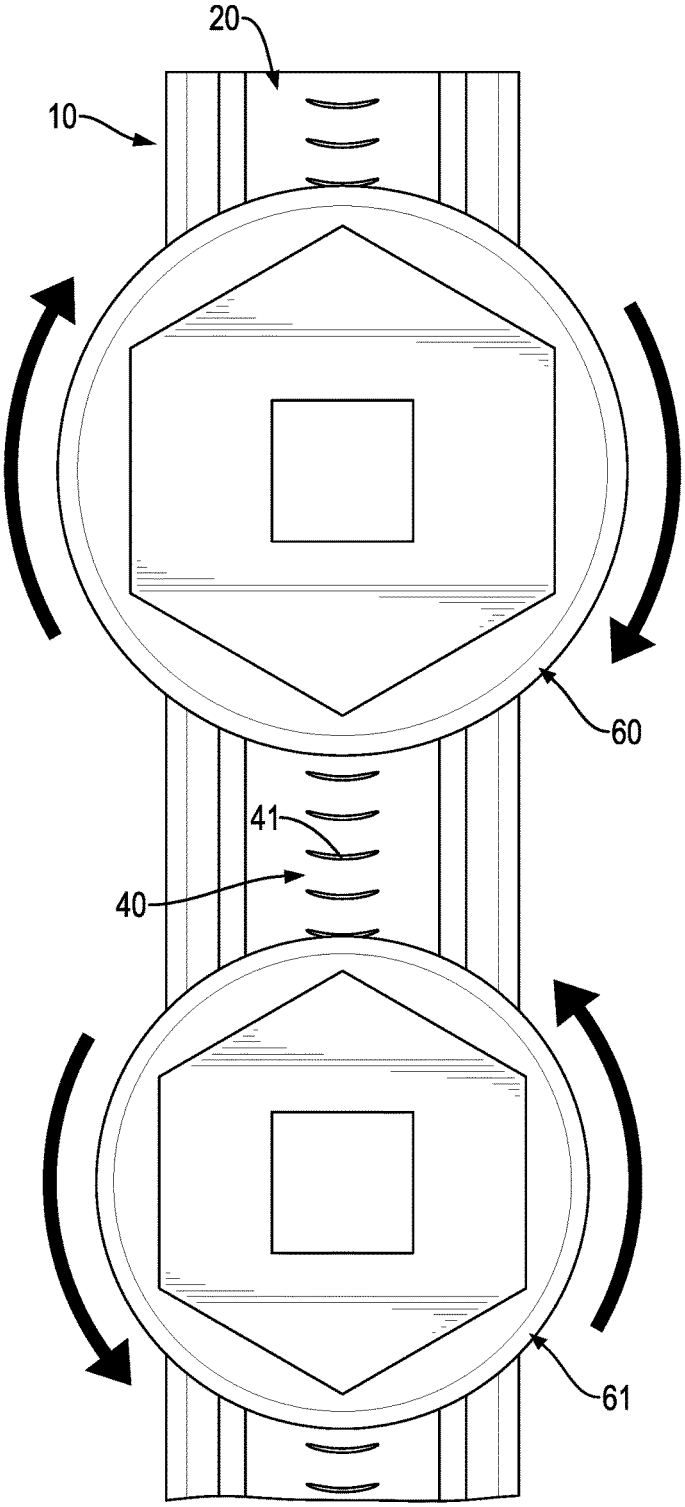
FIG. 5 is an enlarged operational front side view of the hand tool frame in FIG. 1, shown with two sleeves of different sizes mounted on the hand tool frame.

With reference to FIGS. 4 and 5, when the first embodiment of the hand tool frame in the present invention is in use, multiple sleeves 60 (large size), 61 (small size) are respectively and detachably mounted around the inserting buttons of the positioning mounts 30. When each sleeve 60, 61 is mounted around the inserting button of a corresponding positioning mount 30, the protruding ball 321 of the inserting button engages a recess in an inner wall of the sleeve 60, 61. Consequently, the sleeves 60, 61 are positioned on the inserting buttons of the positioning mounts 30. When numbers or signs on the sleeves 60, 61 are not aligned at a same direction to face a user, the user may rotate the sleeves 60, 61 in a clockwise or counterclockwise direction relative to the track base 10 as shown in FIG. 5 to enable the numbers or signs of the sleeves 60, 61 to face the user. During the above-mentioned rotating process, the sliding seats 31 of the positioning mounts 30 may be rotated with the sleeves 60, 61 relative to the positioning board 20 by the engagement between the inserting buttons of the positioning mounts 30 and the sleeves 60, 61.

When the sleeves 60, 61 are rotated to enable the number or sign on the sleeves 60, 61 to face the user, the engaging structure 40 between the positioning board 20 and the at least one positioning mount 30 may enable the engaging ring formed on the at least one positioning mount 30 to engage in one of the engaging slots formed in the positioning board 20. That is, the engaging structure 40 may provide a positioning effect to the at least one positioning mount 30 relative to the positioning board 20. Then, the at least one positioning mount 30 may be positioned securely on the positioning board 20 without rotating relative to the track base 10, and the weights of the sleeves 60, 61 may not force the positioning mounts 30 to move downwardly relative to the track base 10, and the user may see and distinguish the sizes of the sleeves by the numbers or signs easily and conveniently.

Furthermore, when the user wants to take the sleeve 61 (small size) that is mounted on a lower positioning mount 30, the upper positioning mount 30 is positioned on the positioning board 20 without sliding downwardly to shorten a distance between the two adjacent positioning mounts 30 and knocking against the lower positioning mount 30. After using the small size sleeve 61, the user may re-mount the small size sleeve 61 on the lower positioning mount 30 easily without moving the upper positioning mount 30 and the large size sleeve 60 upwardly, and this is convenient in use and storage.

Figure 6:
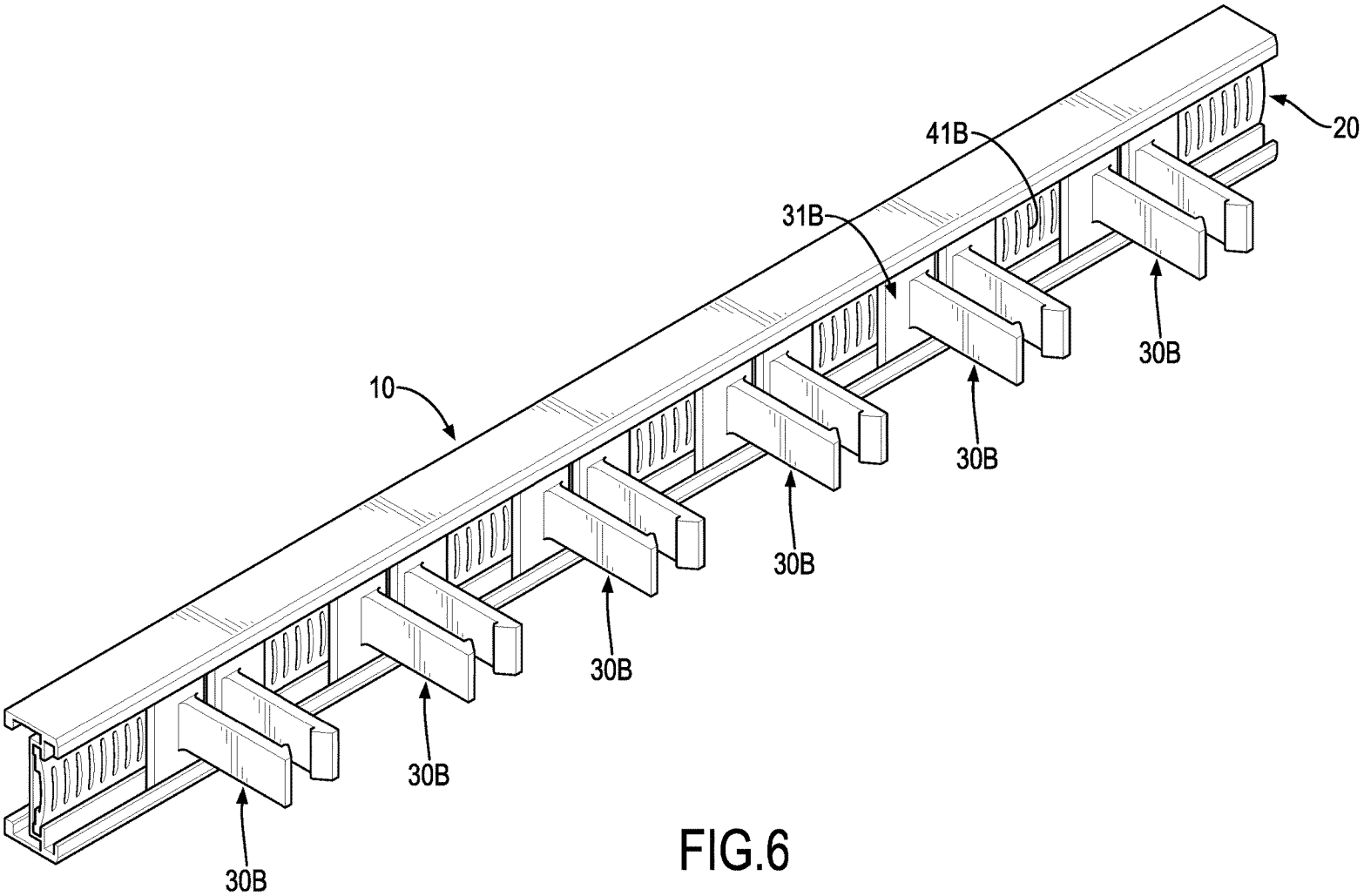
FIG. 6 is a perspective view of a second embodiment of a hand tool frame in accordance with the present invention.
Figure 7:
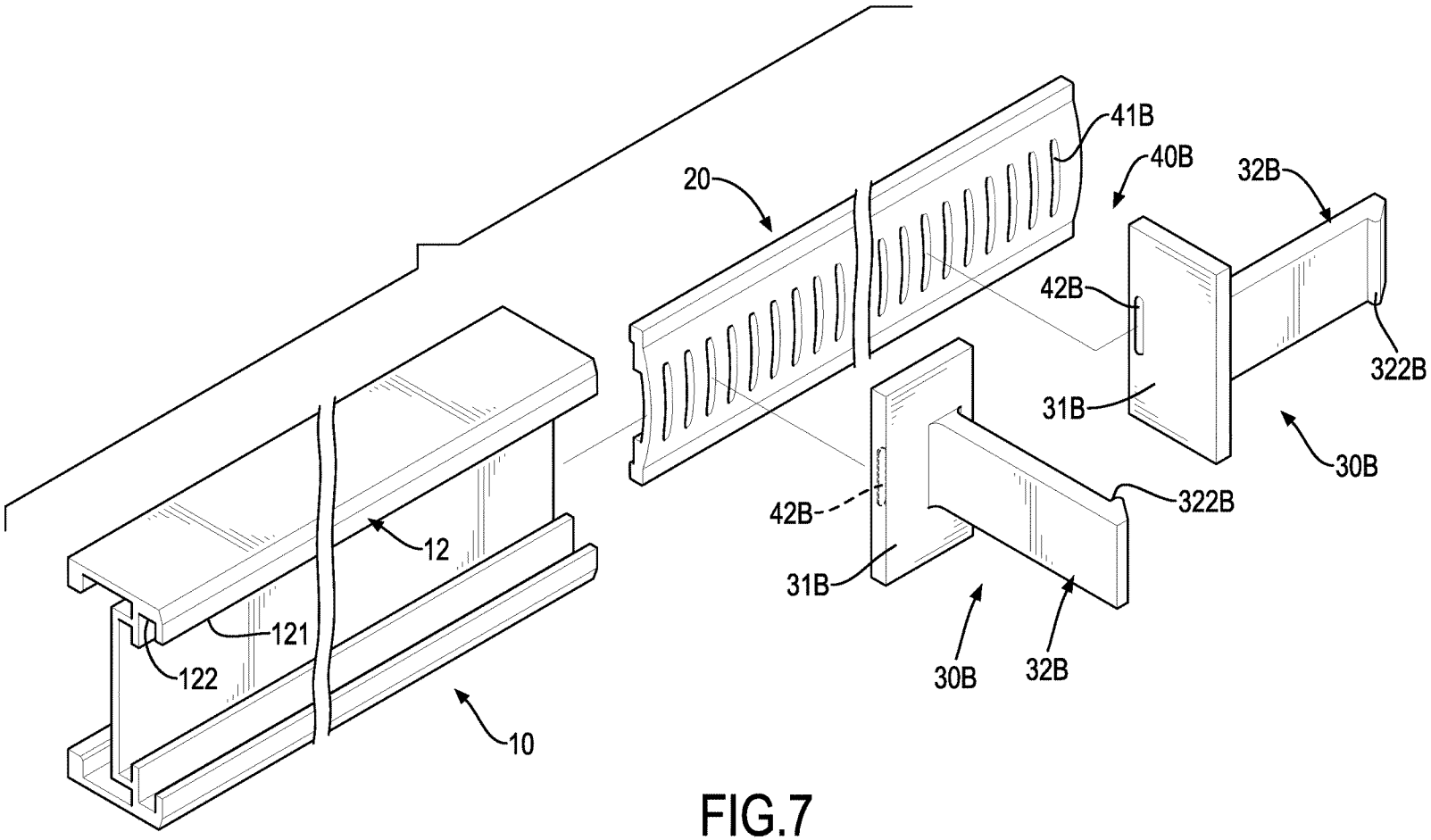
FIG. 7 is an enlarged and exploded perspective view of the hand tool frame in FIG. 6.
Figures 8, 8A, 8B:
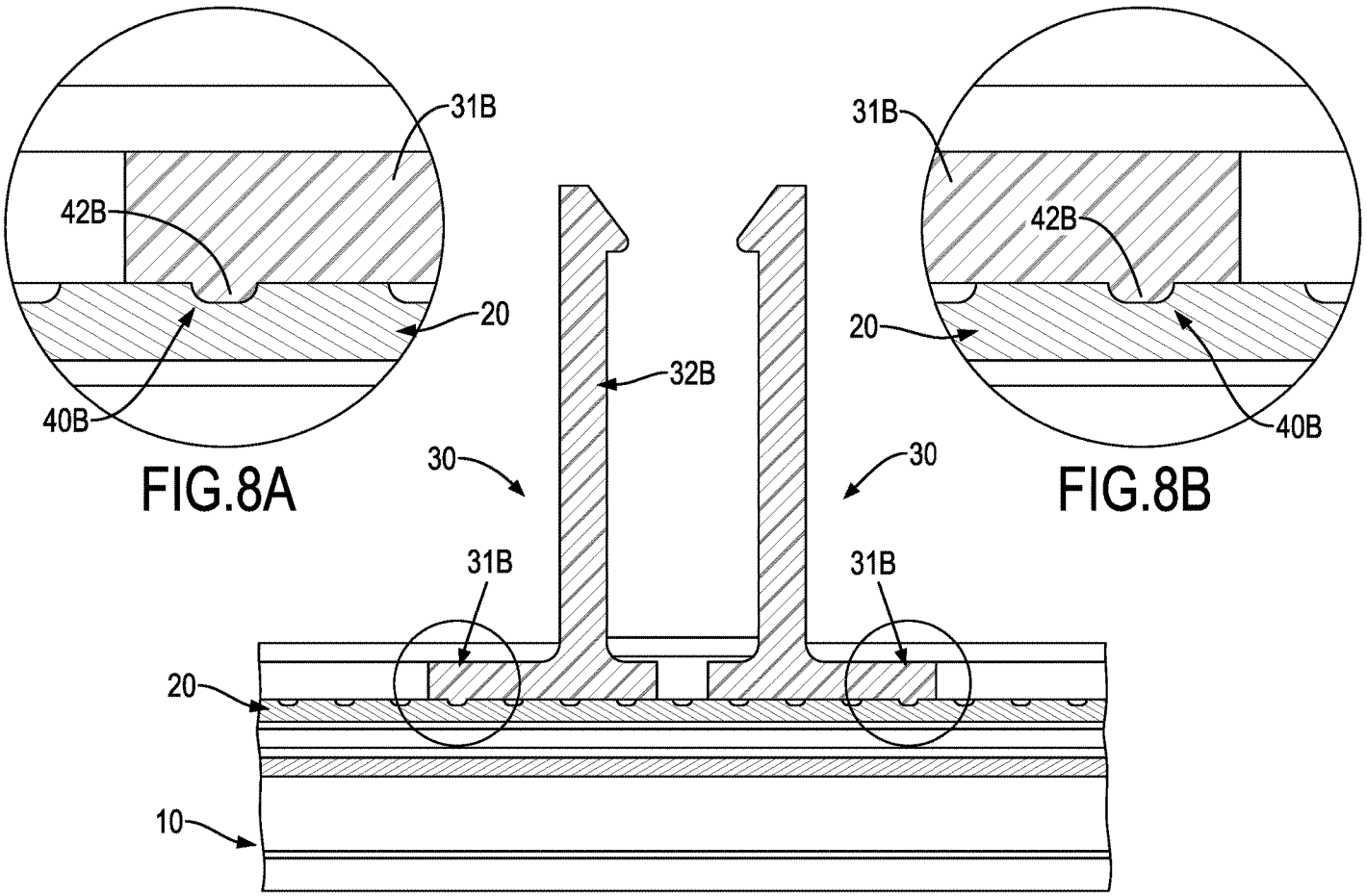
FIG. 8 is an enlarged and cross sectional side view of the hand tool frame in FIG. 6.
FIGS. 8A and 8B are enlarged side views of the hand tool frame in FIG. 8.

With reference to FIGS. 6 to 8, a second embodiment of a hand tool frame in accordance with the present invention is substantially the same as the first embodiment except for the following features. The hand tool frame has at least one pair of positioning mounts 30B. Each one of the at least one pair of positioning mounts 30B has a sliding seat 31B and an extending element 32B. The sliding seat 31B is rectangular and is un-rotatably and slidably mounted in the sliding recess 122 of the slide rail 12. The extending element 32B is a clamping arm and is formed on the front side of the sliding seat 31B and has a free end and a holding hook 322B. The free end of the clamping arm extends out of the slide rail 12 via the front opening 121, and the holding hook 322B is formed on the free end of the clamping arm. The holding hooks 322B of the at least one pair of positioning mounts 30B face to each other, and a holding space is formed between the clamping arms of the at least one pair of positioning mounts 30B.

The engaging structure 40B is formed between the positioning board 20 and each one of the at least one pair of positioning mounts 30B, and has a first engaging segment 41B and a second engaging segment 42B. The first engaging segment 41B is an elongated engaging slot and is formed in the front surface of the positioning board 20 at the middle of the positioning board 20. The second engaging segment 42B is an elongated engaging rib, is formed on and protrudes from the rear side of the sliding seat 31B, and selectively engages with the engaging slot to hold a corresponding positioning mount 30B securely on the positioning board 20.

Figure 9:
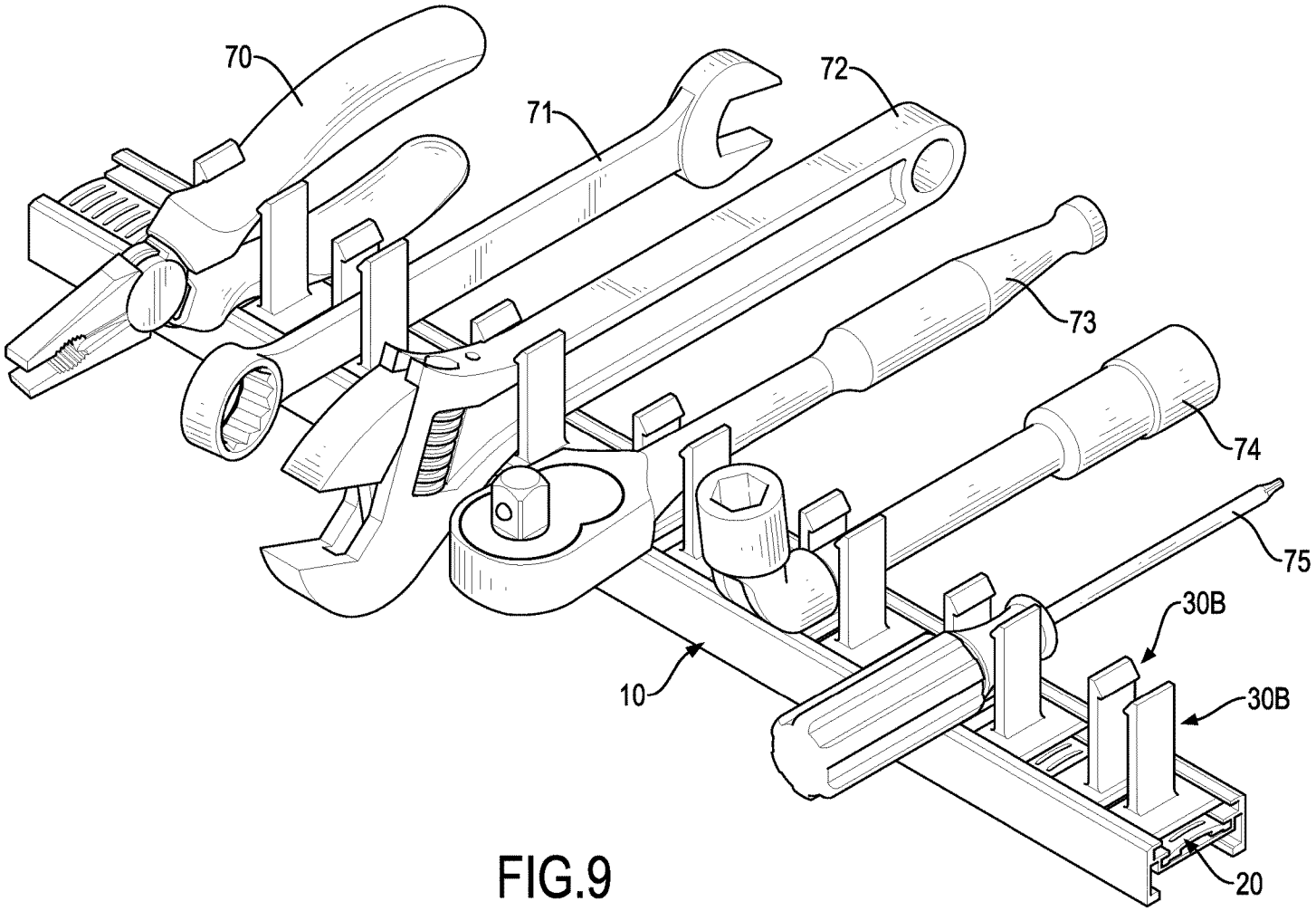
FIG. 9 is an operational perspective view of the hand tool frame in FIG. 6, shown with forceps, wrenches and screwdrivers mounted on the hand tool frame.

With reference to FIG. 9, when the hand tool frame of the second embodiment in the present invention is in use, different kinds of hand tools such as pliers 70, combination spanners 71, adjustable wrenches 72, socket wrenches 73, hexagonal wrenches 74 or screwdrivers 75 may be inserted into a holding space that is formed between the clamping arms of the at least one pair of positioning mounts 30B, and the holding hooks 322B may prevent the hand tool separating from the at least one pair of positioning mounts 30B. Furthermore, the holding space between the clamping arms of the at least one pair of positioning mounts 30B may be adjusted by moving the sliding seats 31B of the at least one pair of positioning mounts 30B along the positioning board 20 relative to the track base 10. After adjusting the holding space between the at least one pair of positioning mounts 30B, the at least one pair of positioning mounts 30B may be positioned on the positioning board 20 by the engaging structure 40B. Then, the different kinds of hand tools may be held securely on the track base 10 by the positioning mounts 30B, and this will improve the practicality of the hand tool frame.

Figure 10:
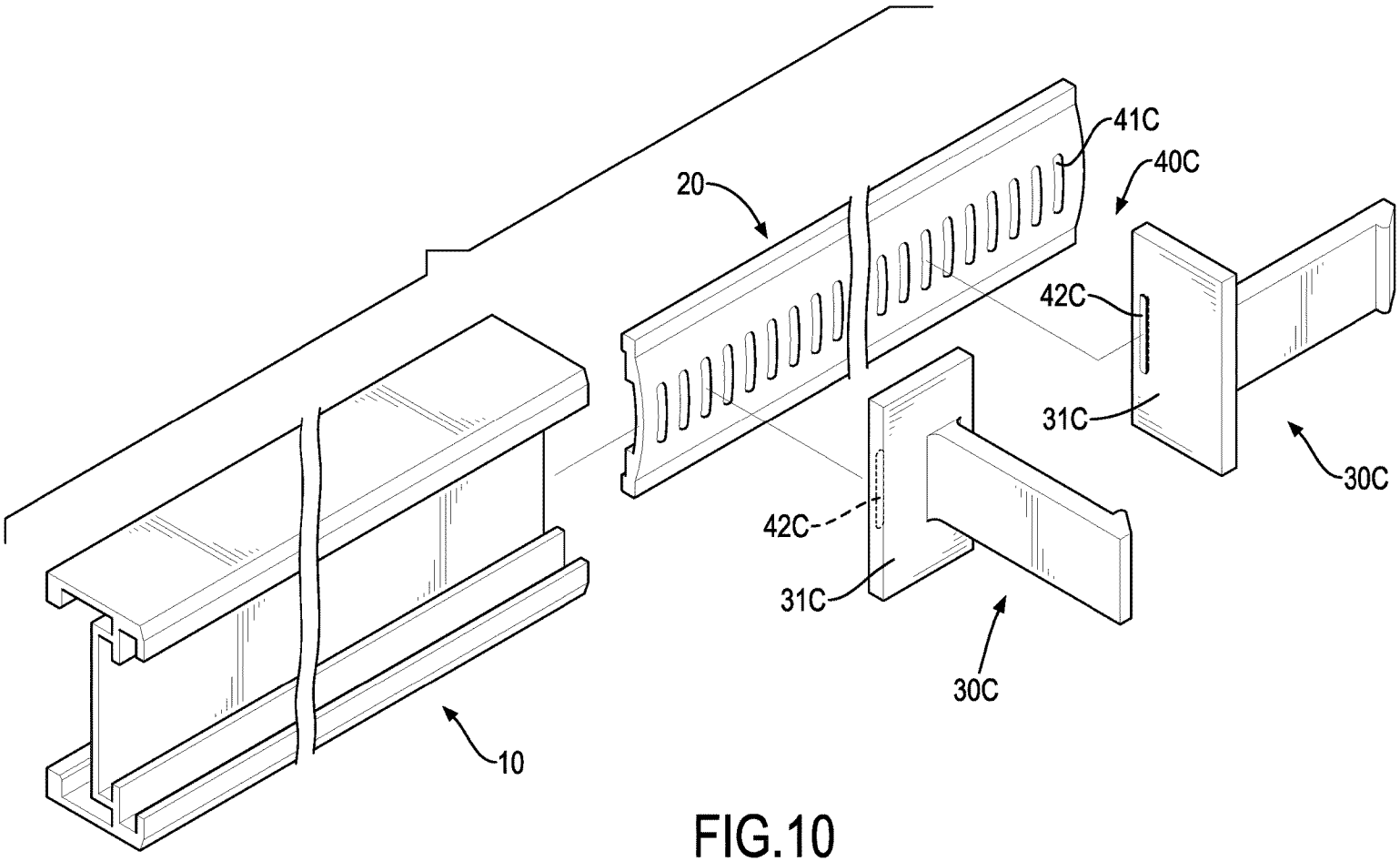
FIG. 10 is an enlarged and exploded perspective view of a third embodiment of a hand tool frame in accordance with the present invention.

With reference to FIG. 10, a third embodiment of a hand tool frame in accordance with the present invention is substantially the same as the second embodiment except for the following features. In the third embodiment, the first engaging segment 41C of the engaging structure 40C is an elongated engaging rib, and is formed on and protrudes from the front surface of the positioning board 20. Additionally, the second engaging segment 42C of the engaging structure 40C is an elongated engaging slot, and is formed in the rear side of the sliding seat 31C, and selectively engages with the engaging rib to hold a corresponding positioning mount 30C securely on the positioning board 20.

Furthermore, the operation of the third embodiment of the hand tool frame is substantially the same as the operation of the second embodiment that is mentioned above, and is not described in detail.

Figure 11:
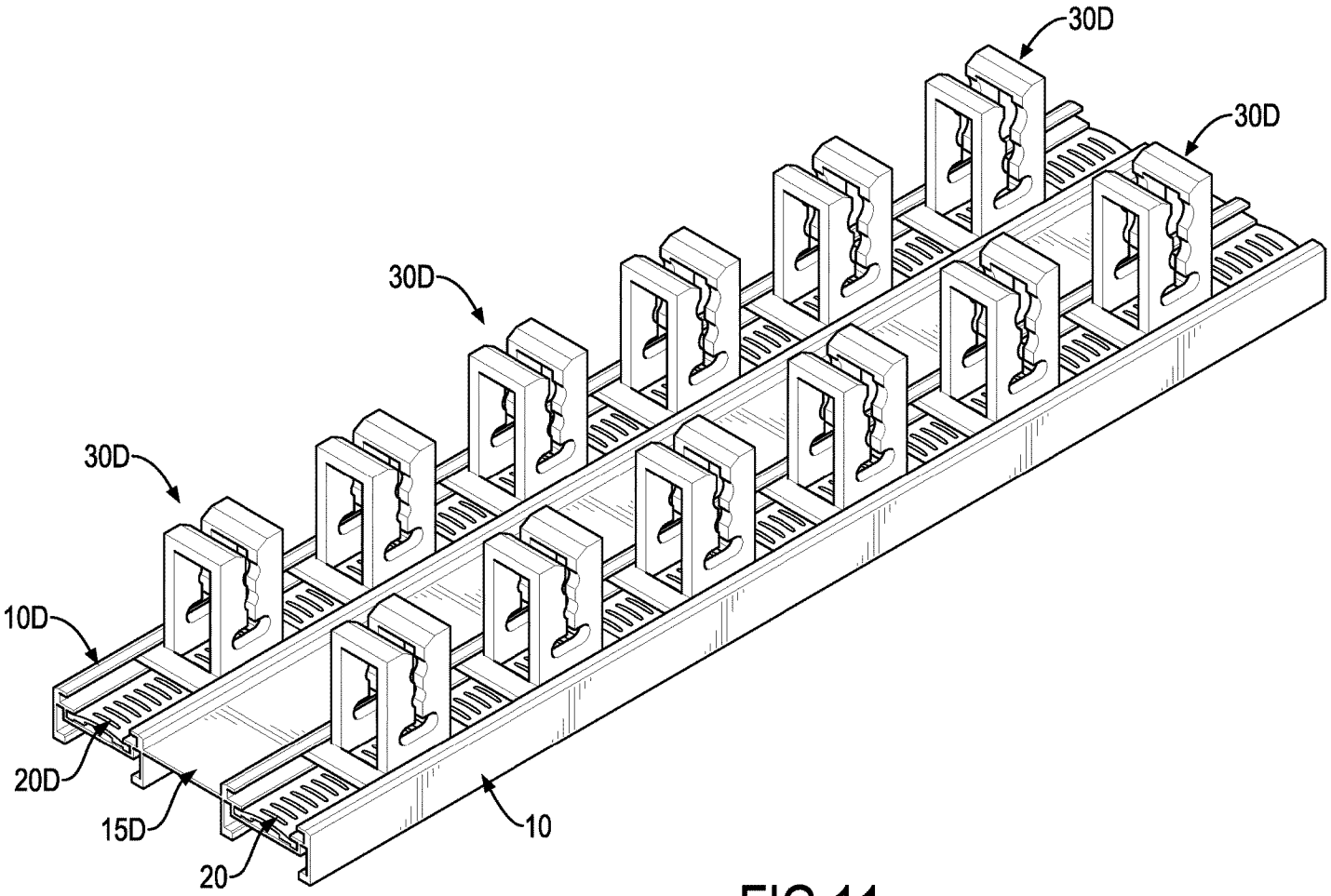
FIG. 11 is a perspective view of a fourth embodiment of a hand tool frame in accordance with the present invention.
Figure 12:
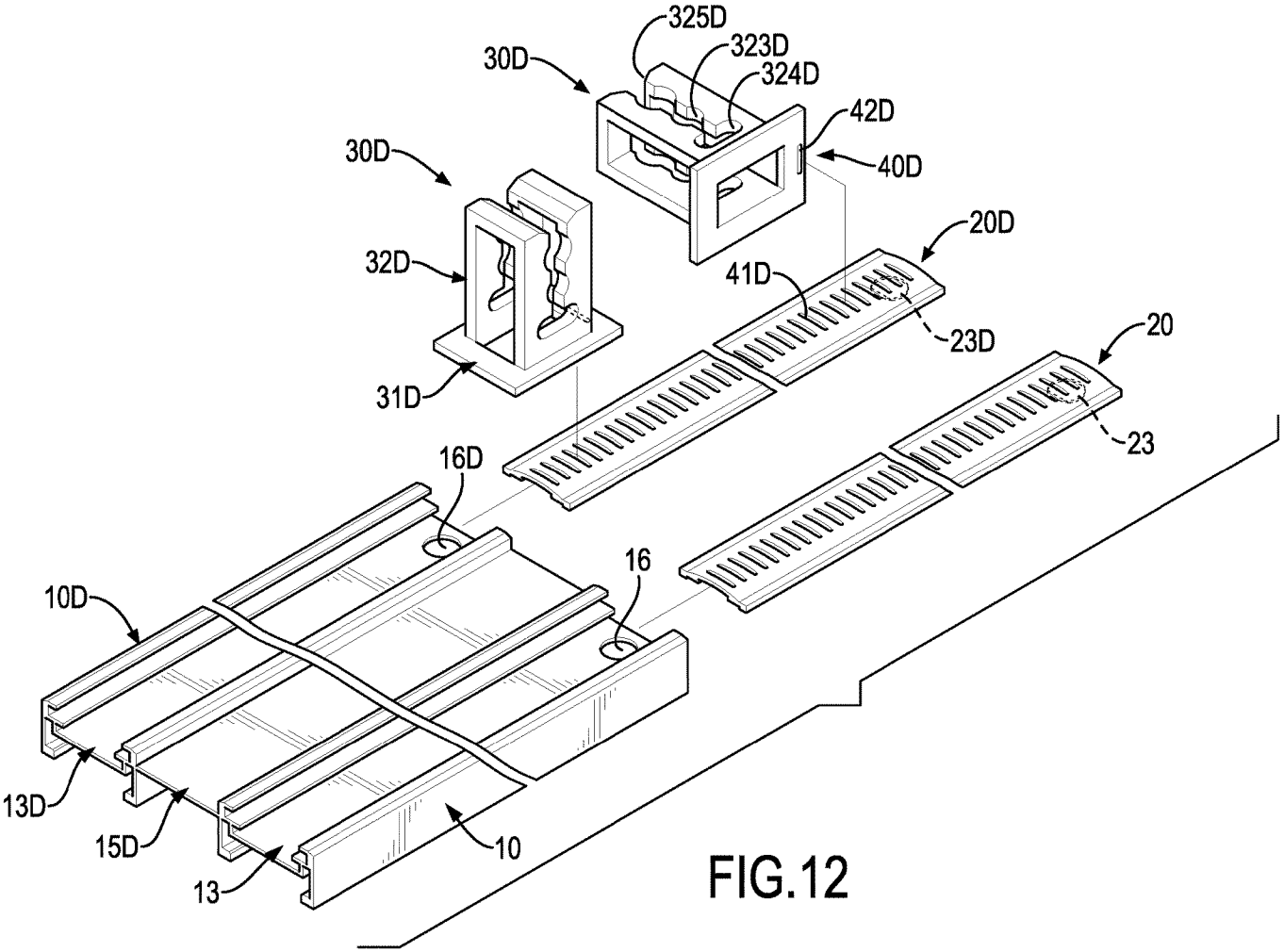
FIG. 12 is an enlarged and exploded perspective view of the hand tool frame in FIG. 11.

With reference to FIGS. 11 and 12, a fourth embodiment of a hand tool frame in accordance with the present invention is substantially the same as the first embodiment except for the following features. The hand tool frame further has an extending track base 10D and an additional positioning board 20D. The extending track base 10D is connected to and parallel with the track base 10 by an extending panel 15D. Furthermore, the structure of the extending track base 10D is substantially the same as the track base 10, and each one of the track bases 10, 10D further has a mounting hole 16, 16D formed through the connecting track 13, 13D adjacent to one of the free ends of the connecting track 13, 13D.

Furthermore, the additional positioning board 20D is mounted in the extending track base 10D, and the structure of the additional positioning board 20D is substantially the same as the positioning board 20, and one of the free ends of each one of the positioning boards 20, 20D is a closed end, and each one of the positioning boards 20, 20D has an engaging protrusion 23, 23D formed on the rear surface of the positioning board 20, 20D adjacent to the closed end of the positioning board 20, 20D. In assembly, the engaging protrusion 23, 23D of each one of the positioning boards 20, 20D engages the mounting hole 16, 16D of a corresponding track base 10, 10D to hold the positioning board 20, 20D securely with the corresponding track base 10, 10D.

Figure 13:
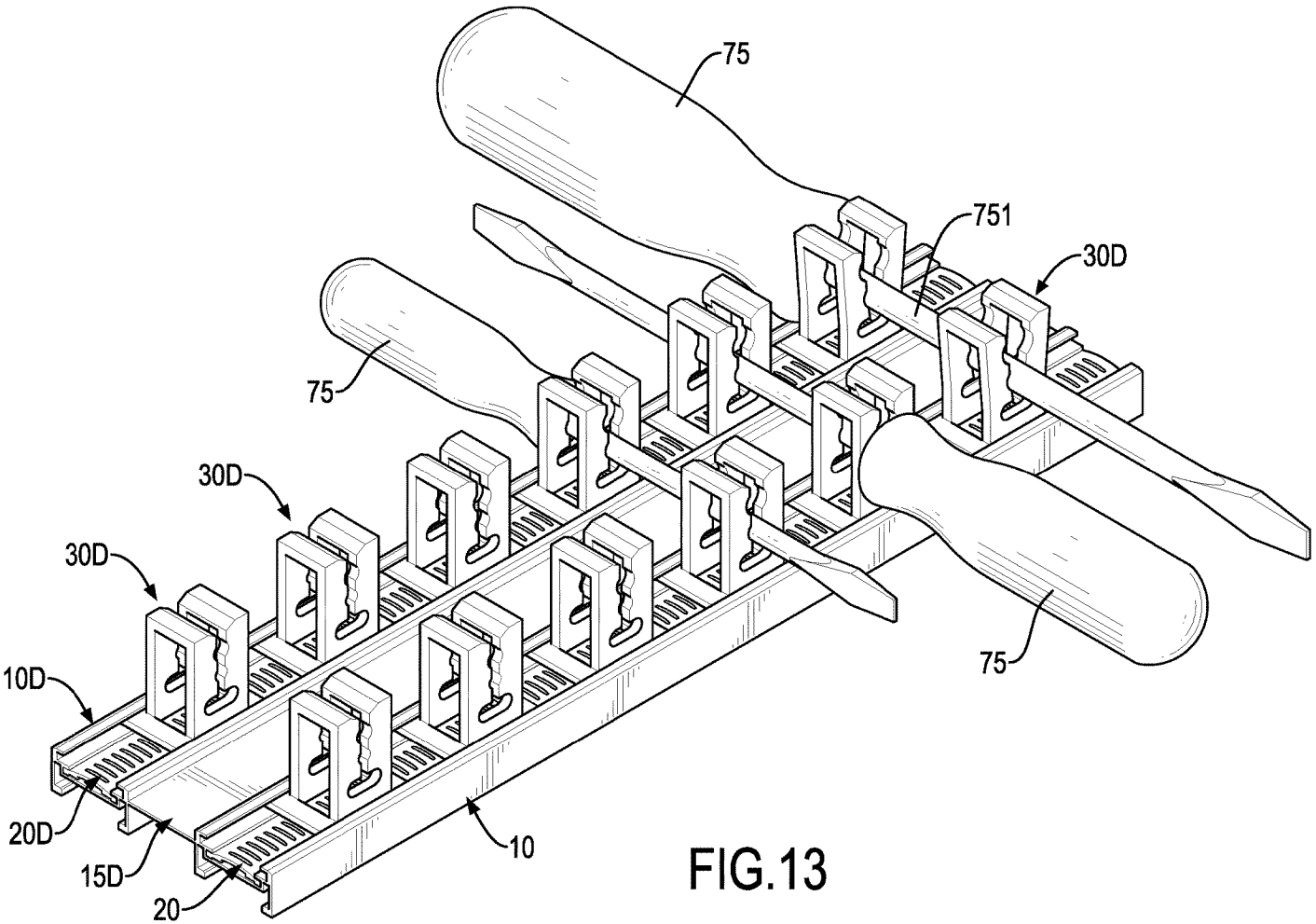
FIG. 13 is an operational perspective view of the hand tool frame in FIG. 11, shown with screwdrivers mounted on the hand tool frame.

The at least one positioning mount 30D is mounted in the track base 10 or the extending track base 10D, and each one of the positioning mount 30D has a sliding seat 31D and an extending element 32D. The sliding seat 31D is rectangular and is un-rotatably and slidably mounted in the track base 10 or the extending track base 10D. The extending element 32D is a hollow block, is formed on the front side of the sliding seat 31D, and has two sidewalls, a front side, at least one tool hole 323D, a tool slot 324D, and a mounting slit 325D. The at least one tool hole 323D is formed through the sidewalls of the extending element 32D to hold a shank 751 of a screwdriver 75 as shown in FIG. 13. The tool slot 324D is formed through the sidewalls of the extending element 32D and communicates with the at least one tool hole 323D. The mounting slit 325D is formed through the front side and the sidewalls of the extending element 32D and communicates with the at least one tool hole 323D opposite to the tool slot 324D.

With reference to FIG. 13, when the hand tool frame of the fourth embodiment in the present invention is in use, a shank 751 of a screwdriver 75 is inserted into two positioning mounts 30D that are respectively mounted in the track bases 10, 10D and align with each other via the mounting slits 325D of the extending elements 32D, and is held between two tool holes 323D of the extending elements 32D. Since the positioning mounts 30D are securely mounted on the track bases 10, 10D by the engaging structure 40D between the positioning mounts 30D and the positioning boards 20, 20D, the screwdrivers 75 may be securely held on the track bases 10, 10D of the hand tool frame, and this may also improve the practicality of the hand tool frame.

Figure 14:
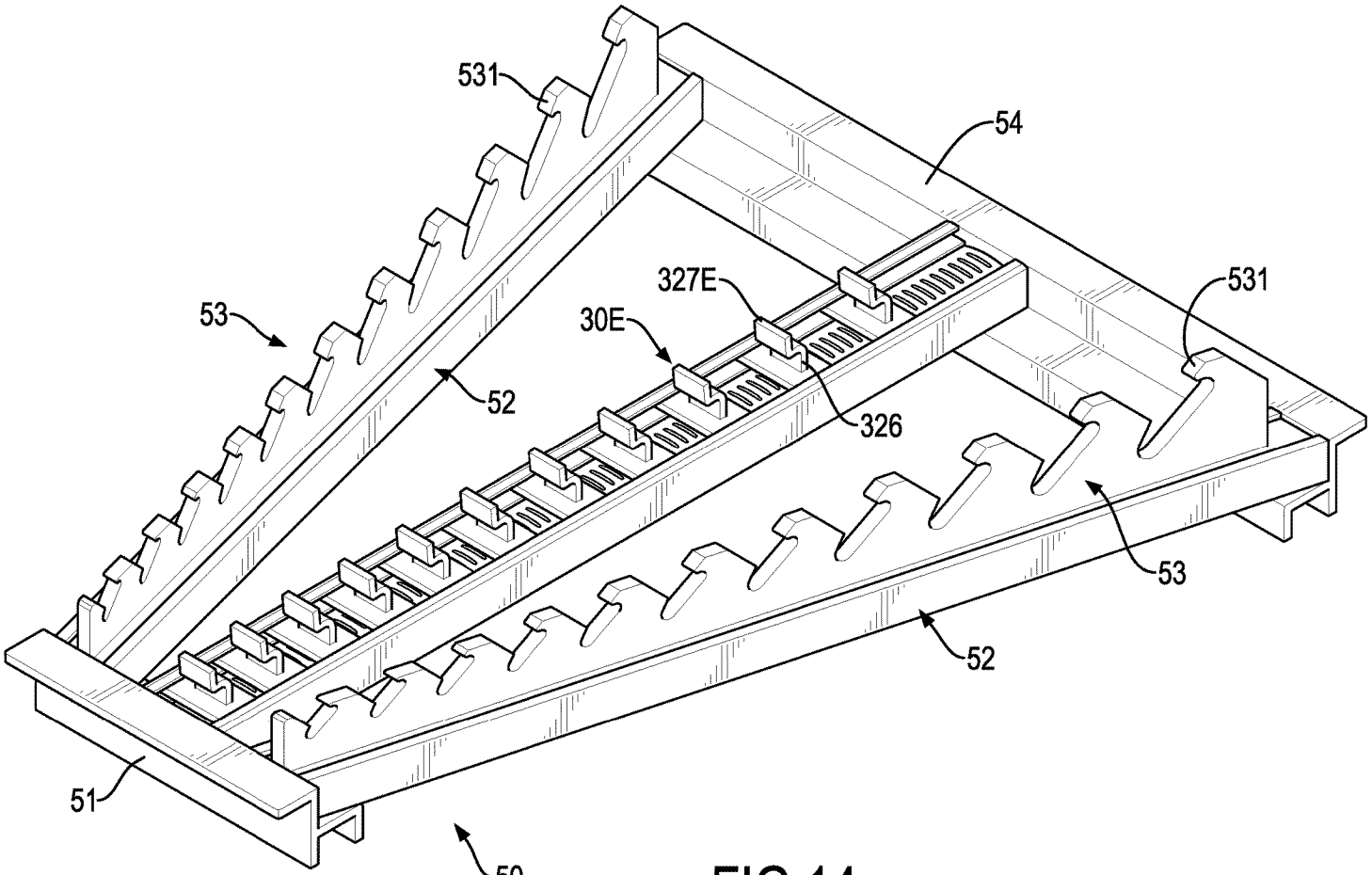
FIG. 14 is a perspective view of a fifth embodiment of a hand tool frame in accordance with the present invention.
Figure 15:
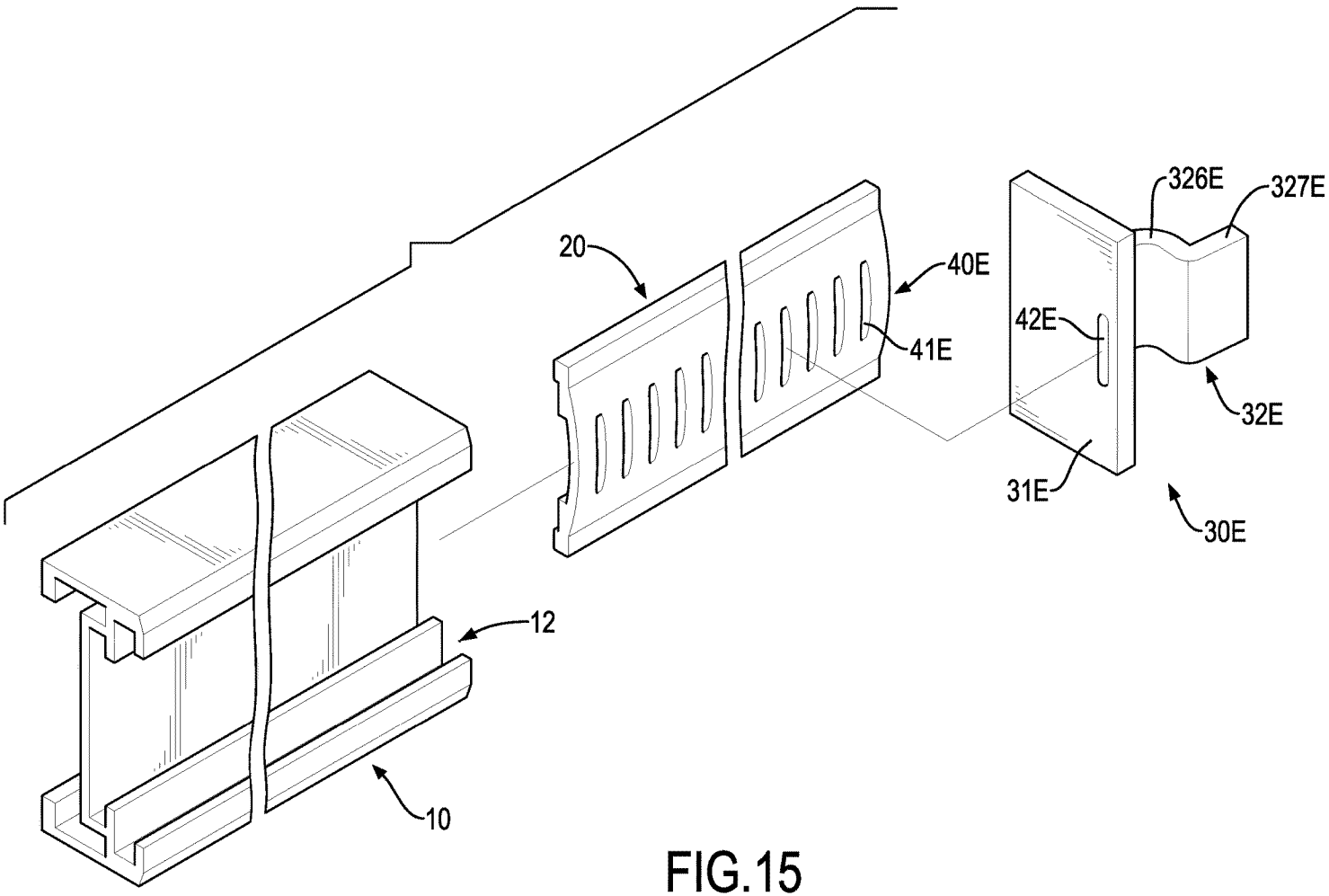
FIG. 15 is an enlarged and exploded perspective view of the hand tool frame in FIG. 14.

With reference to FIGS. 14 and 15, a fifth embodiment of a hand tool frame in accordance with the present invention is substantially the same as the first embodiment except for the following features. The hand tool frame further has an outer frame 50 connected to the track base 10 and having a first supporting mount 51, two side supporting racks 52, two clamping panels 53, and a second supporting mount 54.

The first supporting mount 51 is connected to an end of the track base 10 to provide a holding effect to a user and has a length. The side supporting racks 52 are connected to the first supporting mount 51 beside the track base 10. The clamping panels 53 are respectively mounted in the side supporting racks 52, and each one of the clamping panels 53 has multiple clamping claws 531 continuously formed on a top side of the clamping panel 53 and extending out of a corresponding side supporting rack 52. The second supporting mount 54 is connected to the track base 10 opposite to the first supporting mount 51, is connected to the side supporting racks 52, and has a length longer than the length of the first supporting mount 51. Then, the outer frame 50 is formed as a trapezoid frame by the supporting mounts 51, 54 and the side supporting racks 52.

The at least one positioning mount 30E is un-rotatably mounted in track base 10, and each one of the at least one positioning mount 30E has a sliding seat 31E and an extending element 32E. The sliding seat 31E is rectangular and is un-rotatably and slidably mounted in the slide rail 12 of the track base 10. The extending element 32E is an elastic arm, is formed on the front side of the sliding seat 31E, and has a curved segment 326E and a limiting segment 327E. The curved segment 326E is curvedly formed on and protrudes from the sliding seat 31E and has a free end extending out of the slide rail 12. The limiting segment 327E is formed on and protrudes from the free end of the curved segment 326E of the elastic arm to abut against a combination spanner 71 as shown in FIG. 16.

The engaging structure 40E is formed between the positioning board 20 and each one of the at least one positioning mount 30E, and has a first engaging segment 41E and a second engaging segment 42E. The first engaging segment 41E is an elongated engaging slot and is formed in the front surface of the positioning board 20 at the middle of the positioning board 20. The second engaging segment 42E is an elongated engaging rib, is formed on and protrudes from the rear side of the sliding seat 31E, and selectively engages with the engaging slot to hold a corresponding positioning mount 30E securely on the positioning board 20.

Figure 16:
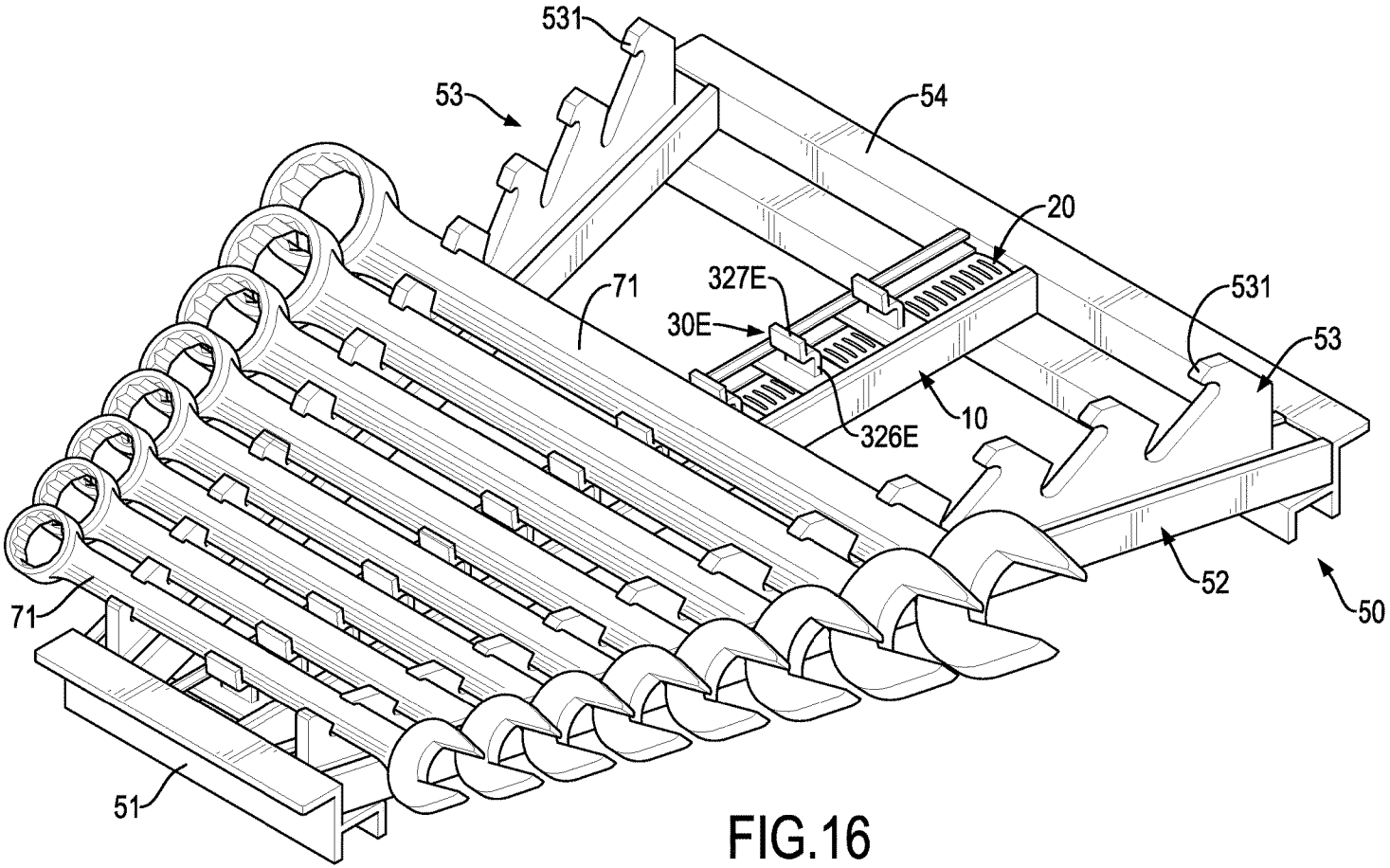
FIG. 16 is an operational perspective view of the hand tool frame in FIG. 14, shown with wrenches of different sizes mounted on the hand tool frame.
Figure 17:
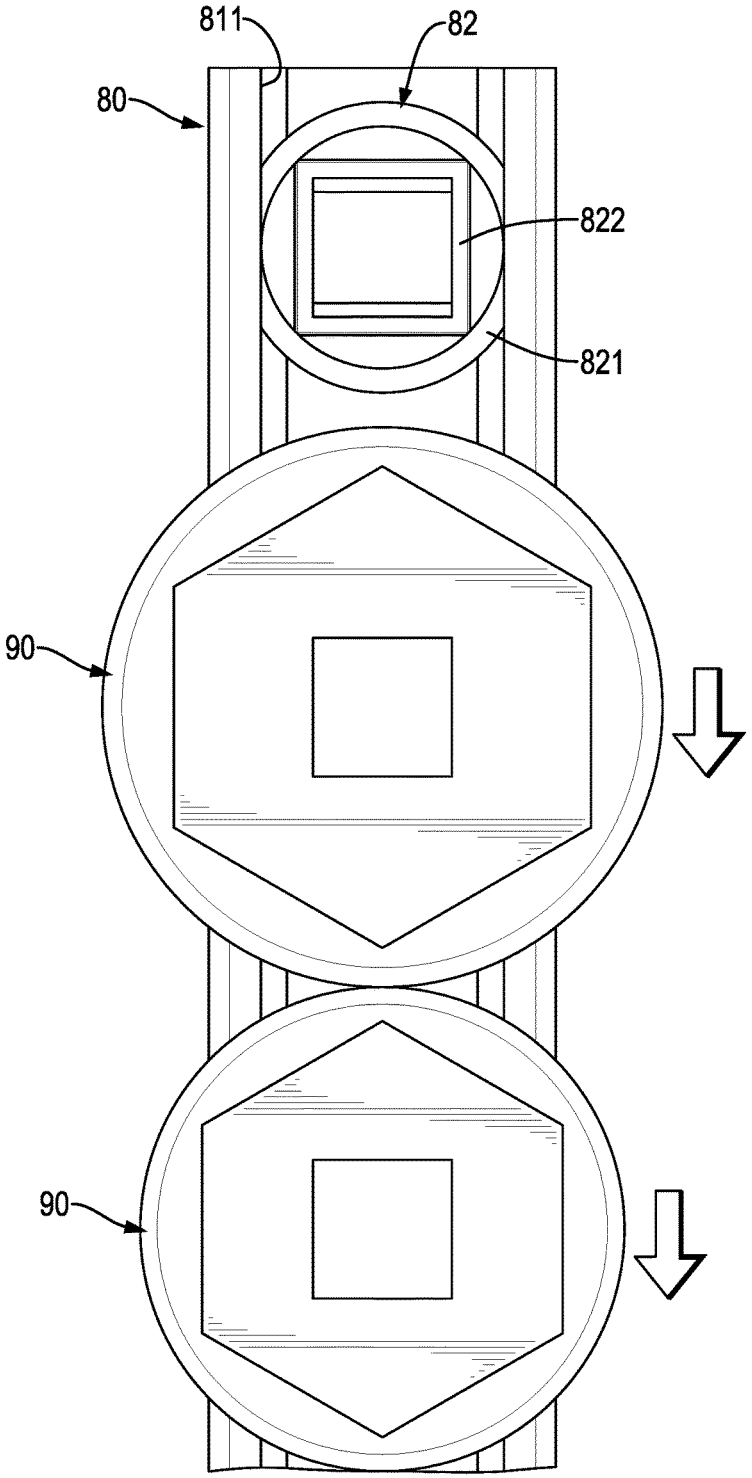
FIG.17 PRIOR ART
FIG. 17 is an enlarged and operational front side view of a hand tool frame in accordance with the prior art, shown with two sleeves mounted on the hand tool frame.

With reference to FIG. 16, when combination spanners 71 of different sizes are mounted on the fifth embodiment of the hand tool frame, the combination spanners 71 are held in the clamping claws 531 of the clamping panels 53, and the position of the extending element 32E of each one of the positioning elements 30E may be adjusted by separating the engagement that is formed by the engaging structure 40E between the positioning board 20 and each one of the positioning mounts 30E, and moving the positioning mounts 30E relative to the track base 10 to enable the limiting segment 327E of the elastic arm to move close to and abut against a corresponding combination spanner 71. Furthermore, the curved segment 326E of the elastic arm may be elastically deformed to closely abut against a corresponding combination spanner 71. Then, the combination spanners 71 of different sizes can be securely held on the hand tool frame between the clamping claws 531 of the clamping panels 53 and the positioning elements 30E, and this also can improve the practicality of the hand tool frame.

What is claimed is:

1. A hand tool frame comprising:

a track base being an elongated seat and having a bottom panel being elongated and having a front surface;

a rear surface;

a top end; and a bottom end; and a slide rail formed on and protruding from the front surface of the bottom panel between the top end and the bottom end of the bottom panel and having a front side;

a front opening formed through the front side of the slide rail; and a sliding recess formed in the slide rail between the front side of the slide rail and the front surface of the bottom panel and communicating with the front opening;

a positioning board mounted in the track base and having two long opposite sides;

two free ends;

a middle, and the positioning board bent forwardly from the long opposite sides of the positioning board to the middle of the positioning board;

a front surface, and the front surface of the positioning board extending toward the slide rail at the middle of the positioning board; and a rear surface;

at least one positioning mount slidably mounted on the track base, and each one of the at least one positioning mount having a sliding seat slidably mounted in the sliding recess of the slide rail and abutting the front surface of the positioning board; and an extending element formed on and protruding forwardly from the sliding seat and extending out of the slide rail via the front opening to provide a tool-holding effect; and an engaging structure formed between the positioning board and the at least one positioning mount to enable the at least one positioning mount to position securely on the positioning board without sliding relative to the track base, and having multiple first engaging segments deposited on the front surface of the positioning board at the middle of the positioning board; and a second engaging segment deposited on the sliding seat of the at least one positioning mount, and selectively engaging the at least one first engaging segment to hold the at least one positioning mount securely on the positioning board without sliding relative to the track base;

when the at least one positioning mount is pushed to move relative to the track base, this enables the second engaging segment of the at least one positioning mount to disengage from one of the multiple first engaging segments of the positioning board and to engage with adjacent one of the multiple first engaging segments of the positioning board to provide a sliding-engaging effect.

2. The hand tool frame as claimed in claim 1, wherein the track base has a connecting track formed on and protruding from the rear surface of the bottom panel, and having a front side formed on and protruding from the rear surface of the bottom panel;

a communicating opening formed through the front side of the connecting track and the rear surface of the bottom panel, and communicating with the sliding recess of the slide rail; and a connecting recess formed between the bottom panel and the connecting track and communicating with the communicating opening;

the positioning board is mounted in the connecting track of the track base and has two rail bars formed on and protruding outwardly from the rear surface of the positioning board respectively at the two long opposite sides of the positioning board and mounted in the connecting recess of the connecting track; and a through recess formed in the rear surface of the positioning board at the middle of the positioning board between the free ends of the positioning board, being parallel with the long opposite sides of the positioning board and communicating with the connecting recess of the connecting track; and the sliding seat of the at least one positioning mount has a rear side facing the communicating opening of the connecting track and abutting the front surface of the positioning board; and a front side facing the front opening of the slide rail.

3. The hand tool frame as claimed in claim 2, wherein each one of the at least one first engaging segment is a curved engaging slot and is formed in the front surface of the positioning board at the middle of the positioning board; and the second engaging segment is an engaging ring, is formed on and protrudes from the rear side of the sliding seat of the at least one positioning mount, and selectively engages the engaging slot on the positioning board.

4. The hand tool frame as claimed in claim 3, wherein the hand tool frame has the multiple first engaging segments deposited on the front surface of the positioning board at spaced intervals to form multiple engaging slots on the positioning board; and a part of the engaging ring engages in one of the engaging slots and a remaining part of the engaging ring presses against the front surface of the positioning board at the middle of the positioning board.

5. The hand tool frame as claimed in claim 4, wherein the sliding seat of each one of the at least one positioning mount is round and is rotatably and slidably mounted in the sliding recess of the slide rail; and the extending element of each one of the at least one positioning mount is an inserting button, and the inserting button is hollow, is rectangular and has a side surface and a protruding ball mounted in and extending outwardly from the side surface of the inserting button.

6. The hand tool frame as claimed in claim 2, wherein the hand tool frame has at least one pair of positioning mounts; and the extending element of each one of the at least one pair of positioning mounts is a clamping arm, is formed on the front side of the sliding seat and has a free end extending out of the slide rail via the front opening; and a holding hook formed on the free end of the clamping arm, and the holding hooks of the at least one pair of positioning mounts facing to each other.

7. The hand tool frame as claimed in claim 6, wherein the sliding seat of each one of the at least one pair of positioning mounts is rectangular and is un-rotatably and slidably mounted in the sliding recess of the slide rail.

8. The hand tool frame as claimed in claim 7, wherein each of the multiple first engaging segments of the engaging structure is an elongated engaging slot and is formed in the front surface of the positioning board at the middle of the positioning board; and the second engaging segment of the engaging structure is an elongated engaging rib, is formed on and protrudes from the rear side of the sliding seat of a corresponding positioning mount, and selectively engages with the engaging slot to hold the corresponding positioning mount securely on the positioning board.

9. The hand tool frame as claimed in claim 7, wherein each of the multiple first engaging segments of the engaging structure is an elongated engaging rib, and is formed on and protrudes from the front surface of the positioning board; and the second engaging segment of the engaging structure is an elongated engaging slot, and is formed in the rear side of the sliding seat of a corresponding positioning mount, and selectively engages with the engaging rib to hold the corresponding positioning mount securely on the positioning board.

10. The hand tool frame as claimed in claim 2, wherein the hand tool frame further has an extending track base connected to and being parallel with the track base by an extending panel, and having a bottom panel being elongated and having a front surface;

a rear surface;

a top end; and a bottom end; and a slide rail formed on and protruding from the front surface of the bottom panel between the top end and the bottom end of the bottom panel and having a front side;

a front opening formed through the front side of the slide rail; and a sliding recess formed in the slide rail between the front side of the slide rail and the front surface of the bottom panel and communicating with the front opening;

an additional positioning board mounted in the extending track base and having two long opposite sides;

two free ends;

a middle, and the additional positioning board bent forwardly from the long opposite sides of the additional positioning board to the middle of the additional positioning board;

a front surface, and the front surface of the additional positioning board extending toward the slide rail of the extending track base at the middle of the additional positioning board; and each one of the track bases further has a mounting hole formed through the connecting track adjacent to a free end of the connecting track; and one of the free ends of each one of the positioning boards is a closed end, and each one of the positioning boards has an engaging protrusion formed on the rear surface of the positioning board adjacent to the closed end of the positioning board and engaging the mounting hole of a corresponding track base to hold the positioning board securely with the corresponding track base.

11. The hand tool frame as claimed in claim 10, wherein the sliding seat of each one of the at least one positioning mount is rectangular and is un-rotatably and slidably mounted in the track base or the extending track base; and the extending element of the each one of the at least one positioning mount is a hollow block, is formed on the front side of the sliding seat, and has two sidewalls;

a front side;

at least one tool hole formed through the sidewalls of the extending element to hold a shank of a screwdriver;

a tool slot formed through the sidewalls of the extending element and communicating with the at least one tool hole; and a mounting slit formed through the front side and the sidewalls of the extending element and communicating with the at least one tool hole opposite to the tool slot.

12. The hand tool frame as claimed in claim 2, wherein the hand tool frame further has an outer frame connected to the track base and having a first supporting mount connected to an end of the track base to provide a holding effect to a user and having a length;

two side supporting racks connected to the first supporting mount beside the track base;

two clamping panels respectively mounted in the two side supporting racks, and each one of the clamping panels having multiple clamping claws continuously formed on a top side of the clamping panel and extending out of a corresponding side supporting rack; and a second supporting mount connected to the track base opposite to the first supporting mount, connected to the side supporting racks, and having a length longer than the length of the first supporting mount to form a trapezoid shape of the outer frame between the supporting mounts and the side supporting racks.

13. The hand tool frame as claimed in claim 12, wherein the sliding seat of each one of the at least one positioning mount is rectangular and is un-rotatably and slidably mounted in the slide rail of the track base; and the extending element of each one of the at least one positioning mount is an elastic arm, is formed on the front side of the sliding seat, and has a curved segment curvedly formed on and protruding from the sliding seat and having a free end extending out of the slide rail; and a limiting segment formed on and protruding from the free end of the curved segment of the elastic arm.

14. A hand tool frame comprising:

a track base being an elongated seat and having a bottom panel being elongated and having a front surface;

a rear surface;

a top end; and a bottom end; and a slide rail formed on and protruding from the front surface of the bottom panel between the top end and the bottom end of the bottom panel and having a front side;

a front opening formed through the front side of the slide rail; and a sliding recess formed in the slide rail between the front side of the slide rail and the front surface of the bottom panel and communicating with the front opening;

a positioning board mounted in the track base and having two long opposite sides;

two free ends;

a middle, and the positioning board bent forwardly from the long opposite sides of the positioning board to the middle of the positioning board;

a front surface, and the front surface of the positioning board extending toward the slide rail at the middle of the positioning board; and a rear surface;

at least one positioning mount slidably mounted on the track base, and each one of the at least one positioning mount having a sliding seat slidably mounted in the sliding recess of the slide rail and abutting the front surface of the positioning board; and an extending element formed on and protruding forwardly from the sliding seat and extending out of the slide rail via the front opening to provide a tool-holding effect; and an engaging structure formed between the positioning board and the at least one positioning mount to enable the at least one positioning mount to position securely on the positioning board without sliding relative to the track base, and having at least one first engaging segment deposited on the front surface of the positioning board at the middle of the positioning board; and a second engaging segment deposited on the sliding seat of the at least one positioning mount, and selectively engaging the at least one first engaging segment to hold the at least one positioning mount securely on the positioning board without sliding relative to the track base, wherein the track base has a connecting track formed on and protruding from the rear surface of the bottom panel, and having a front side formed on and protruding from the rear surface of the bottom panel;

a communicating opening formed through the front side of the connecting track and the rear surface of the bottom panel, and communicating with the sliding recess of the slide rail; and a connecting recess formed between the bottom panel and the connecting track and communicating with the communicating opening;

the positioning board is mounted in the connecting track of the track base and has two rail bars formed on and protruding outwardly from the rear surface of the positioning board respectively at the two long opposite sides of the positioning board and mounted in the connecting recess of the connecting track; and a through recess formed in the rear surface of the positioning board at the middle of the positioning board between the free ends of the positioning board, being parallel with the long opposite sides of the positioning board and communicating with the connecting recess of the connecting track; and the sliding seat of the at least one positioning mount has a rear side facing the communicating opening of the connecting track and abutting the front surface of the positioning board; and a front side facing the front opening of the slide rail, and wherein the hand tool frame further has an extending track base connected to and being parallel with the track base by an extending panel, and having a bottom panel being elongated and having a front surface;

a rear surface;

a top end; and a bottom end; and a slide rail formed on and protruding from the front surface of the bottom panel between the top end and the bottom end of the bottom panel and having a front side;

a front opening formed through the front side of the slide rail; and a sliding recess formed in the slide rail between the front side of the slide rail and the front surface of the bottom panel and communicating with the front opening;

an additional positioning board mounted in the extending track base and having two long opposite sides;

two free ends;

a middle, and the additional positioning board bent forwardly from the long opposite sides of the additional positioning board to the middle of the additional positioning board;

a front surface, and the front surface of the additional positioning board extending toward the slide rail of the extending track base at the middle of the additional positioning board; and each one of the track bases further has a mounting hole formed through the connecting track adjacent to a free end of the connecting track; and one of the free ends of each one of the positioning boards is a closed end, and each one of the positioning boards has an engaging protrusion formed on the rear surface of the positioning board adjacent to the closed end of the positioning board and engaging the mounting hole of a corresponding track base to hold the positioning board securely with the corresponding track base.

15. The hand tool frame as claimed in claim 14, wherein the sliding seat of each one of the at least one positioning mount is rectangular and is un-rotatably and slidably mounted in the track base or the extending track base; and the extending element of the each one of the at least one positioning mount is a hollow block, is formed on the front side of the sliding seat, and has two sidewalls;

a front side;

at least one tool hole formed through the sidewalls of the extending element to hold a shank of a screwdriver;

a tool slot formed through the sidewalls of the extending element and communicating with the at least one tool hole; and a mounting slit formed through the front side and the sidewalls of the extending element and communicating with the at least one tool hole opposite to the tool slot.

* * * * *